US008485867B2

(12) United States Patent
Wu

(10) Patent No.: US 8,485,867 B2
(45) Date of Patent: Jul. 16, 2013

(54) HONING APPARATUS

(75) Inventor: Shih-Piao Wu, Changhua (TW)

(73) Assignee: Jiin Haur Industrial Co. Ltd., Changhua (TW)

( * ) Notice: Subject to any disclaimer, the term of this patent is extended or adjusted under 35 U.S.C. 154(b) by 332 days.

(21) Appl. No.: 13/087,692

(22) Filed: Apr. 15, 2011

(65) Prior Publication Data

US 2012/0264358 A1 Oct. 18, 2012

(51) Int. Cl.
*B24B 23/00* (2006.01)

(52) U.S. Cl.
USPC ..... 451/349; 451/45; 451/556; 76/82.2

(58) Field of Classification Search
USPC ..... 451/349, 5, 371, 556; 76/82, 82.2, 76/88
See application file for complete search history.

(56) References Cited

U.S. PATENT DOCUMENTS

| | | | | | |
|---|---|---|---|---|---|
| 371,689 | A | * | 10/1887 | Kistner | 76/82.2 |
| 561,926 | A | * | 6/1896 | Titus | 76/82.2 |
| 579,726 | A | * | 3/1897 | St. Hilaire | 76/82.2 |
| 1,904,075 | A | * | 4/1933 | Petrich | 76/82.2 |
| 2,082,948 | A | * | 6/1937 | Gerdin | 76/82.1 |
| 2,518,111 | A | * | 8/1950 | Amendola | 451/371 |
| 2,716,850 | A | * | 9/1955 | Reitzes | 451/552 |
| 2,813,384 | A | * | 11/1957 | Deputy | 451/555 |
| 4,884,343 | A | * | 12/1989 | Sewell | 30/169 |
| D390,084 | S | * | 2/1998 | McCabe, Jr. | D8/62 |
| 6,626,066 | B2 | * | 9/2003 | Koppe | 76/87 |
| 6,782,576 | B1 | * | 8/2004 | Valencic et al. | 7/158 |
| 7,066,796 | B2 | * | 6/2006 | Pfaus | 451/344 |
| 7,108,595 | B2 | * | 9/2006 | Reisinger | 451/461 |
| 7,153,200 | B1 | * | 12/2006 | Wu | 451/344 |
| D618,532 | S | * | 6/2010 | Wu | D8/71 |
| D673,439 | S | * | 1/2013 | Wu | D8/93 |

* cited by examiner

*Primary Examiner* — Lee D Wilson
*Assistant Examiner* — Joel Crandall
(74) *Attorney, Agent, or Firm* — Che-Yang Chen; Law Office of Michael Chen

(57) ABSTRACT

An improved structure of a honing apparatus includes a body, a suction unit, a control unit, a driving unit, a connecting unit and a upper cap, wherein a base is formed at circumference of the body and a trough is formed in the middle of the base, and a sliding trough is formed at one side wall on the other side of the body and a first hone is formed at a top surface of the body. At center of one lateral surface of the suction unit has an extended pulling stick and an eccentric protruding portion is formed in the control unit, while the other lateral surface has an extended manipulating portion. The driving unit has a threaded stick that has a rotating button at one enlarged end. The connecting unit has a through opening at a closer end of a lateral surface and a threaded unit is inside the connecting unit and aligned with the through opening. A second hone is hingedly formed at a top surface of the connecting unit close to the other end. A bottom surface of the upper cap corresponding to the sliding trough has a recessed portion, and a hole is formed to enable the first hone to penetrate upward.

4 Claims, 9 Drawing Sheets

HONING APPARATUS

FIELD OF THE INVENTION

The present invention is related to a honing apparatus, and more specifically to a honing apparatus with a suction base for both single-blade and dual-blade tools.

BACKGROUND OF THE INVENTION

After being used for a long period of time, the blade of a knife can be worn and becomes dull. Once the knife becomes dull, people usually use a sharpening stone to hone the knife to restore its sharpness. Since conventional sharpening stone is bulky and not easy to store, a smaller and lighter honing apparatus becomes more popular in market. Also, the honing apparatus is usually coupled with a suction unit to secure the honing apparatus.

As can be seen in FIG. 9, a conventional honing apparatus with the suction unit includes: a honing body (70), a suction unit (71), a control component (72) and a top cap (73), wherein the honing body (70) has a through hole in the middle thereof and the suction unit (71) can generate vacuum suction force when it is attached to a flat surface. A pulling rod is extended from a center of a lateral surface and penetrates through the through hole of the honing body (70) to hingedly secure the control component (72). The control component (72) has an eccentric protruding component (721) and an extended actuating unit (722) on the other side. The top cap (73) is engaged with the honing body on the top thereof and a sharpening stone with a V-shaped opening is formed on the top of the honing body.

When a user uses the honing apparatus, the suction unit (71) is attached to the flat surface and the actuating unit (722) is managed to be against the honing body (70) with the eccentric protruding component (721). When the suction unit (71) is pulled, a corresponding vacuum force in the suction unit (71) is generated. Furthermore, the honing body (70) pushes down the circumference of the suction unit (71) to secure it on the flat surface. At this time, the user can hone dull single-blade knives (e.g. kitchen knives, fruit knives, etc.) at the sharpening stone (731) until the knives become sharp again.

However, the abovementioned honing apparatus only focuses on single-blade knives. If the user wants to hone dual-blade tools such as scissors or garden shears, the two blades of the dual-blade tools cannot be completely open due to the thickness of the honing apparatus so that the conventional honing apparatus cannot be efficiently used on dual-blade tools. Even if the two blades can be totally separated, it may be too troublesome during the entire honing process. Furthermore, many of the dual-blade tools cannot be separated. Therefore, there remains a need for a new and improved honing apparatus which can be used for both single-blade and dual-blade tools.

SUMMARY OF THE INVENTION

The technical problem to be solved in the present invention is that conventional honing apparatus cannot be used for dual-blade tools such as scissors and garden shears.

The technical point to solve the problem mentioned above is that the present invention provides a improved honing apparatus including: a body, a suction plate, a control unit, a driving unit, a connecting unit and an upper cap, wherein the body is hollow with a downward opening and a through hole in the middle of the body, and a protruding base is formed around circumference of the body, wherein a trough is formed in the middle of the base and the trough penetrates both forward and upward, and the base has a sliding trough formed at one side wall of the body to connect the trough and outer space, and a first hone with a V-shaped opening is at a top surface of the body. The suction plate is attached to a smooth surface to generate a vacuum suction force, wherein a pulling stick is extended from a center of one lateral surface of the body and the pulling stick is through the through hole of the body to hingedly secure the control unit and its components which have an eccentric protruding unit, and the other lateral surface of the body has a manipulating portion. The driving unit has a threaded stick that has a rotating button at one enlarged end, and the connecting unit is elongated and a through opening is located at a closer end of a lateral surface. A threaded unit is aligned with the through opening in the connecting unit, wherein the threaded unit is a screw nut and a top surface of the connecting unit close to the other end has a second hone engaged with the connecting unit, such that the second hone can swingingly move along an edge of the knife and keep contacting the knife during the honing process. An escaping bevel is tangentially formed at the connecting unit corresponding to the second hone, wherein the upper cap matches the body to cover an upper portion of the base and a bottom surface corresponding to the sliding trough has a recessed portion, and a hole is formed to enable the first hone to penetrate upward.

Comparing with conventional techniques, the present invention has the following advantages: (i) the honing base has both the first hone and the second hone, and the second hone can hone both single-blade and dual-blade knives with different movement design in the same structure. Also, when honing dual-blade knives, it is not necessary to separate the blades from the knife. So, the design can serve the purposes of convenience and good applicability; (ii) the extension of the second hone can be adjusted according to the size of the dual-blade tools. So, the structure in the present invention is more flexible during the honing process; (iii) when the use finishes honing, the second hone can be completely hidden in the body, so it not only saves space, but also prevents the user from hurting since the user may accidentally touch the second hone; (iv) the structure in the present invention is simple and easy to assemble, so that the costs of materials, assembly and molding can be reduced; (v) the honing base in the present invention is easy to operate since the user only has to know some simple operations (e.g. rotating, horizontal moving, etc.); and (vi) the second hone can swing according to different thickness of the blade, so that the second hone can keep contacting the blade and averagely hone it.

DETAILED DESCRIPTION OF THE INVENTION

Figure 1:
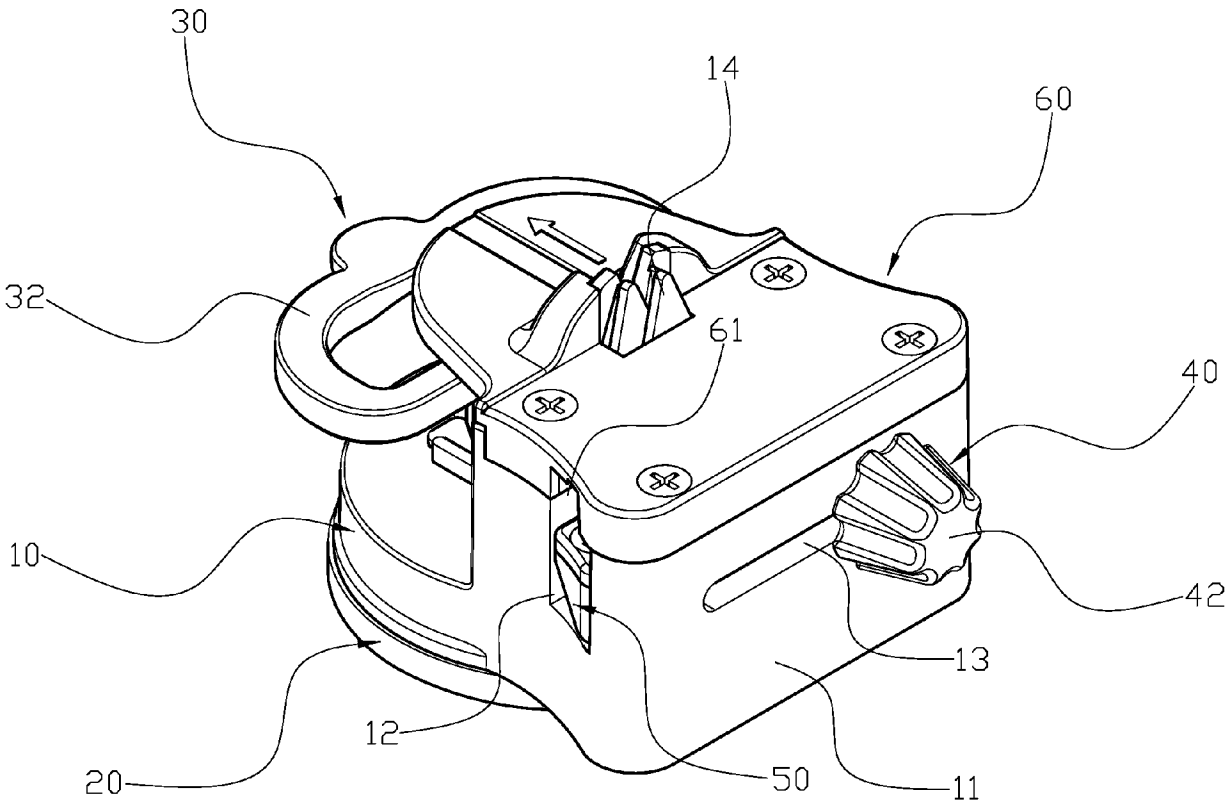
FIG. 1 illustrates a three-dimensional assembled view in the present invention.
Figure 2:
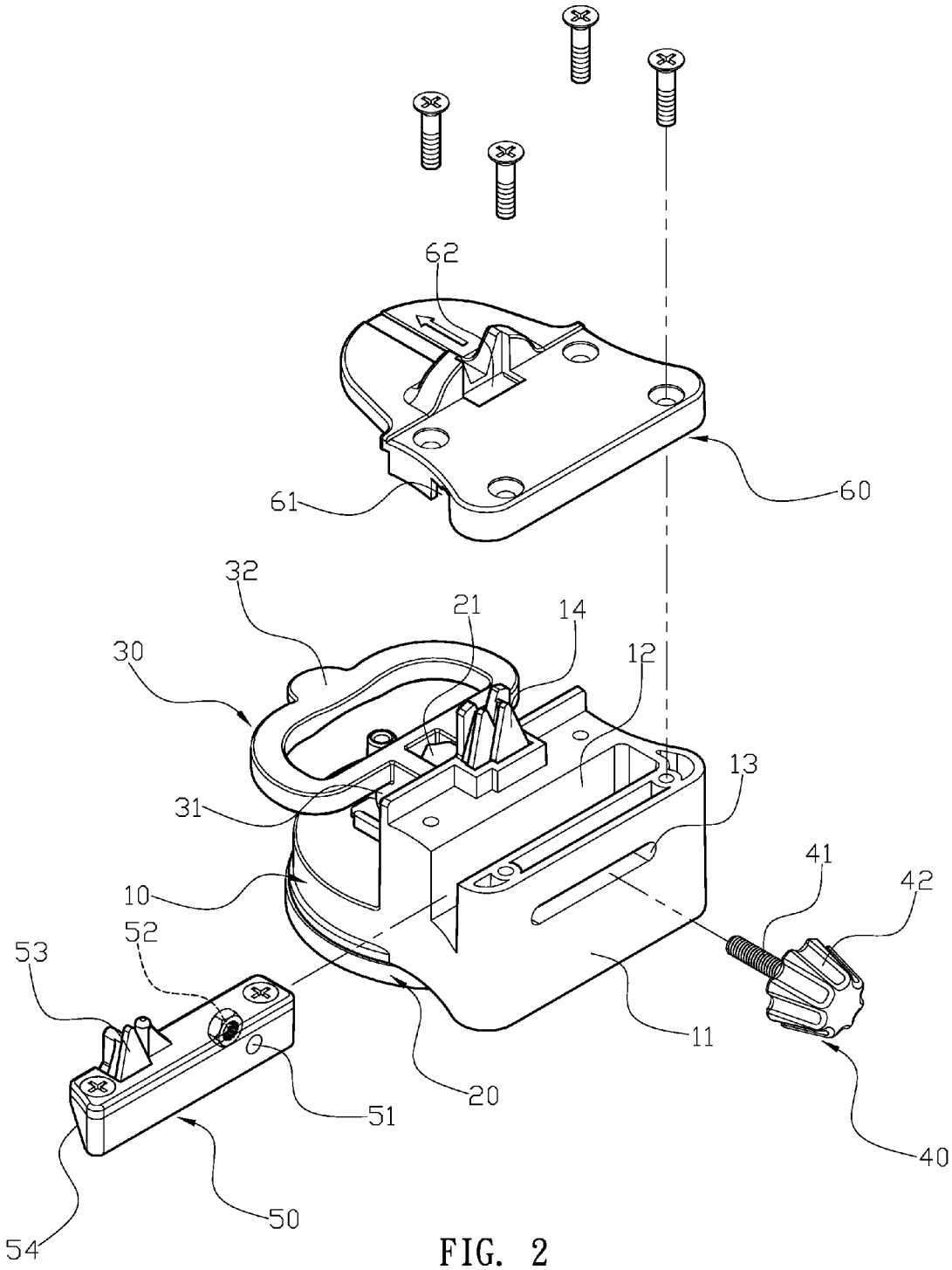
FIG. 2 illustrates a three-dimensional exploded view in the present invention.
Figure 3:
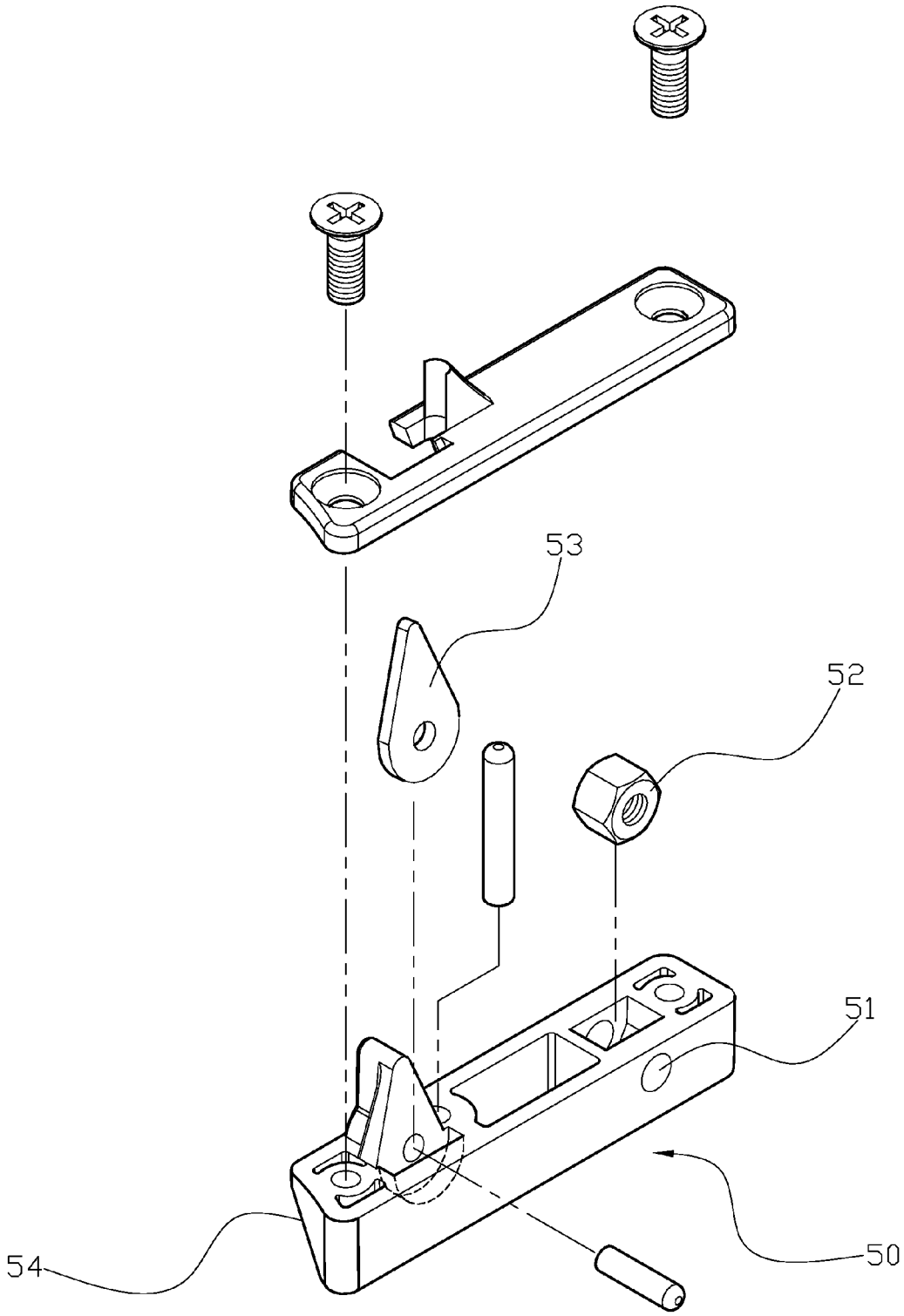
FIG. 3 illustrates an enlarged three-dimensional view of the connecting unit in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications which might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 5, an improved structure for honing a includes: a body (10), a suction plate (20), a control unit (30), a driving unit (40), a connecting unit (50) and an upper cap (60), wherein the body (10) is a hollow body with a downward opening and a through hole in the middle of the body (10), and a protruding base (11) is formed around circumference of the body (10), wherein a trough (12) is formed in the middle of the base (11) and the trough (12) penetrates both forward and upward. The base (11) has a sliding trough (13) formed at one side wall of the body to connect the trough (12) and outer space, and a first hone (14) with a V-shaped opening is at the top surface of the body (10). The suction plate (20) is attached to a smooth surface to generate a vacuum suction force, wherein a pulling stick (21) is extended from a center of one lateral surface of the body (10) and the pulling stick is through the through hole of the body (10) to secure the control unit (30) and its components that have an eccentric protruding unit (31), and the other lateral surface of the body (10) has a manipulating portion (32). The driving unit (40) has a threaded stick (41) which has a rotating button (42) at one enlarged end, and the connecting unit (50) is elongated and a through opening (51) is located at a close end of a lateral surface and a threaded unit (52) is aligned with the through opening (51) in the connecting unit (50). The threaded unit (52) is a screw nut and a top surface of the connecting unit (50) close to the other end has a second hone (53) engaged with the connecting unit (50), such that the second hone (53) can swingingly move along an edge of the knife and keep contacting the knife during the honing process, and an escaping bevel (54) is tangentially formed at the connecting unit (50) corresponding to the second hone (53), wherein the upper cap (60) matches the body (10) to cover an upper portion of the base (11) and a bottom surface corresponding to the sliding trough (13) has a recessed portion (61), and a hole (62) is formed to enable the first hone (14) to penetrate upward.

Figure 4:
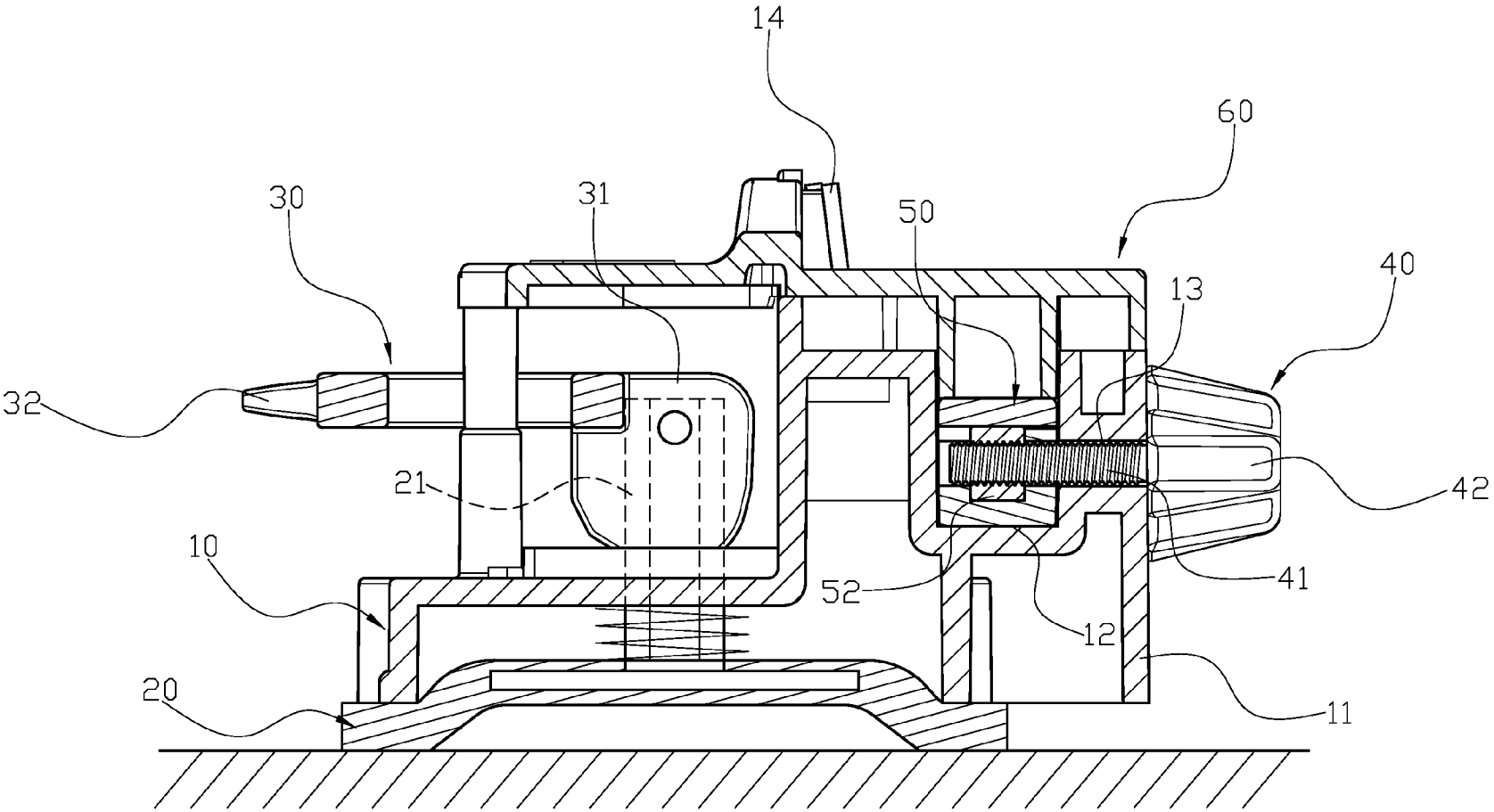
FIG. 4 illustrates an assembled sectional view in the present invention.
Figure 5:
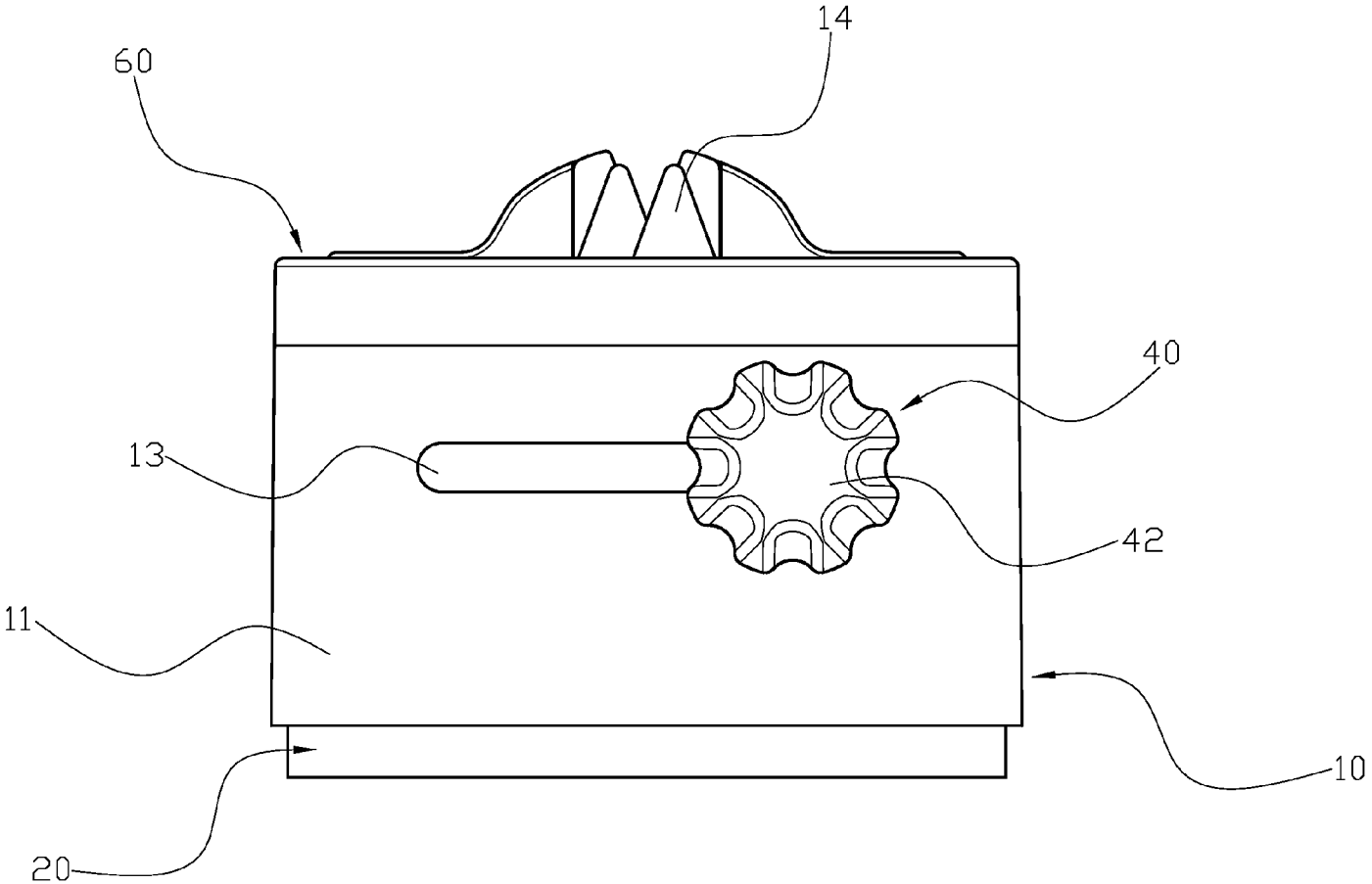
FIG. 5 is an assembled two-dimensional view in the present invention.

Referring to FIGS. 1, 4 and 5, the connecting unit (50) is inserted into the trough (12) of the body (10) when the second hone (53) faces outside, and the threaded stick (41) of the driving unit (40) is inserted from the sliding trough (13) and through the through opening (51) of the connecting unit (50) to screw onto the threaded unit (52). When the driving unit (40) is tightly screwed and forces an inner face of the rotating button (42) on the base (11), the driving unit (40) and the connecting unit (50) are secured, and the upper cap (60) can match the body (10) when the recessed portion (61) and the hole (62) are escaping. Furthermore, a screw is used to connect the body (10) and the upper cap (60).

Figure 6:
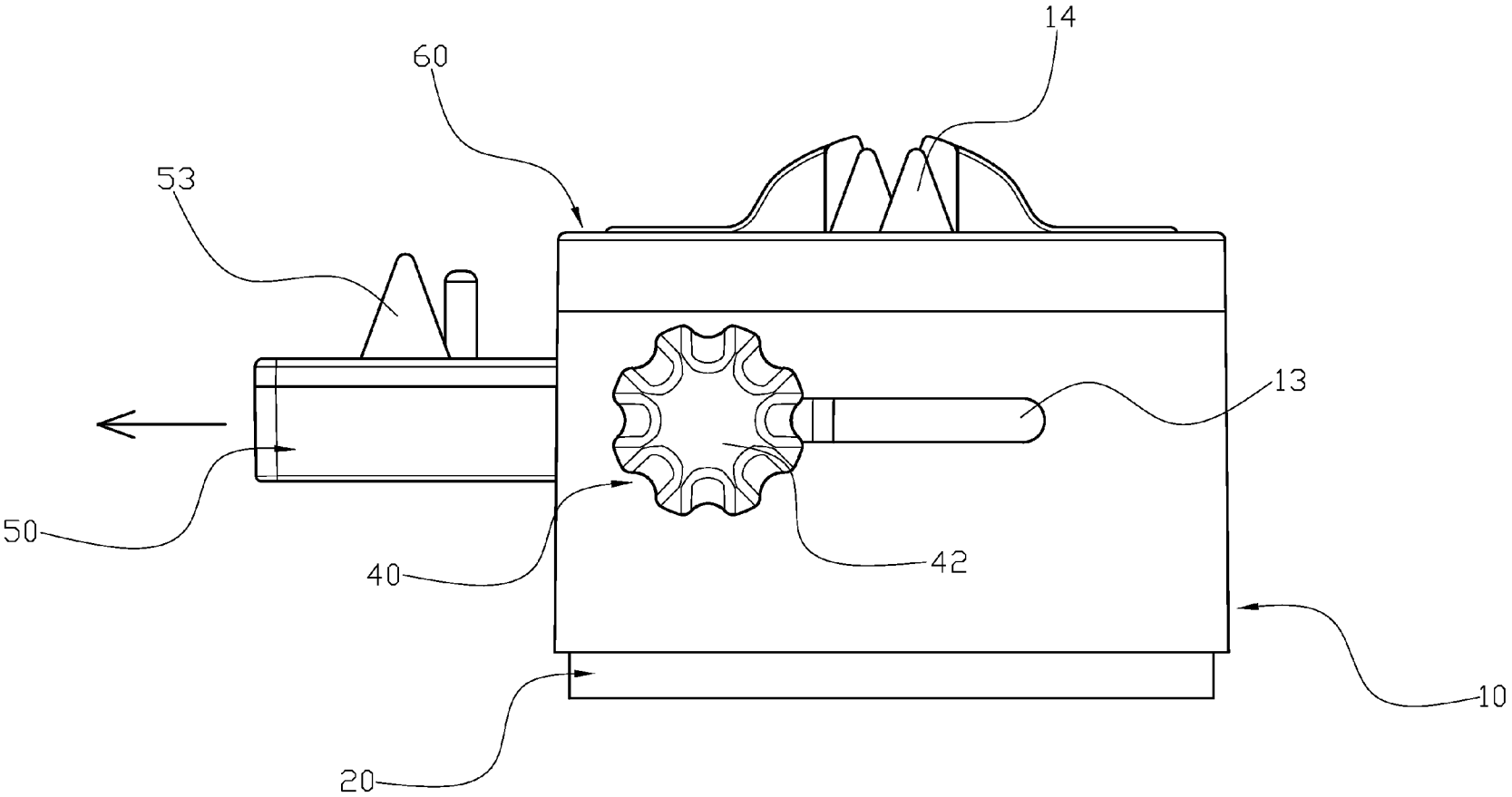
FIG. 6 is a schematic view of horizontal movement of the second hone in the present invention.
Figure 7:
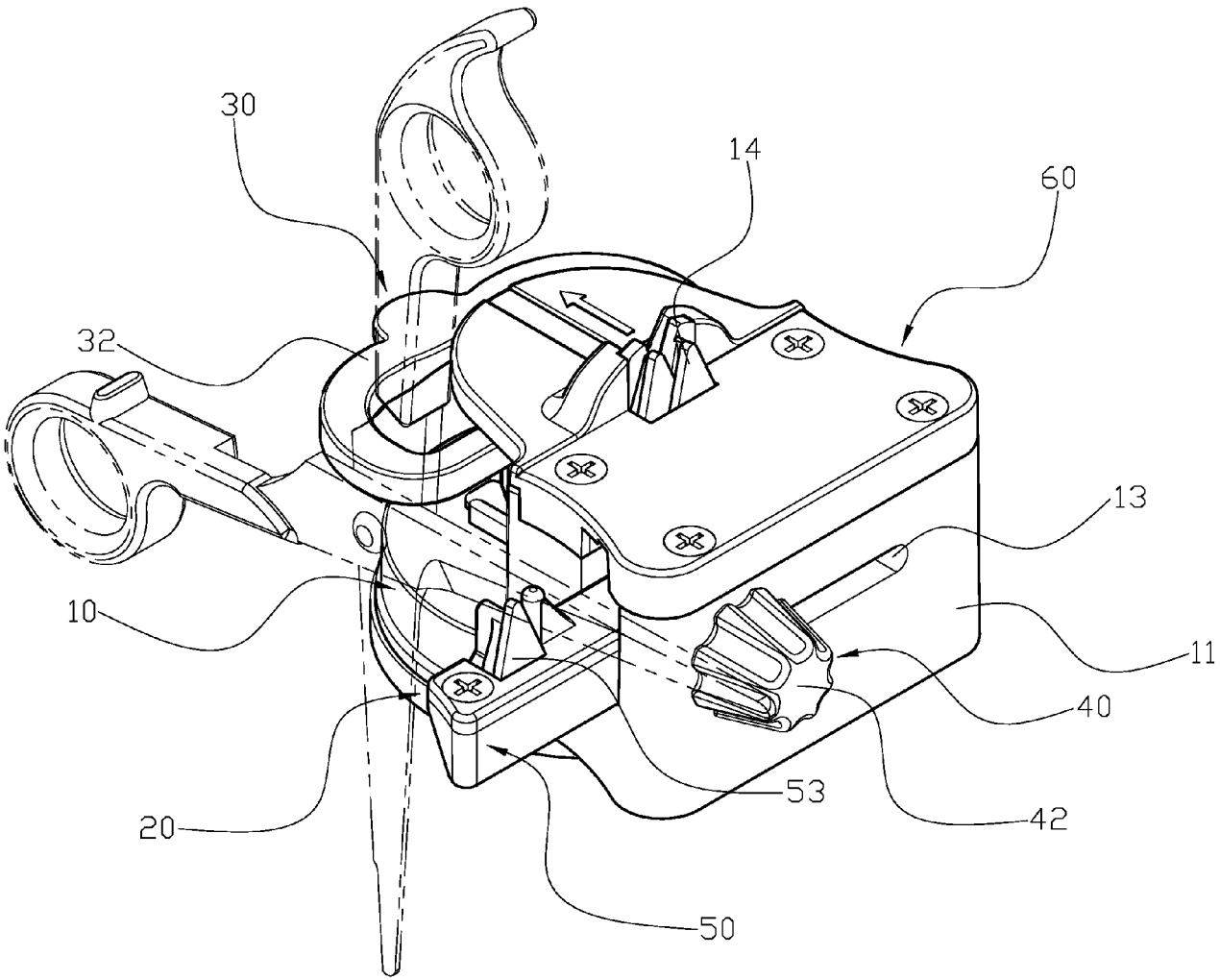
FIG. 7 is a schematic view of honing a dual-blade tool in the present invention.
Figure 8:
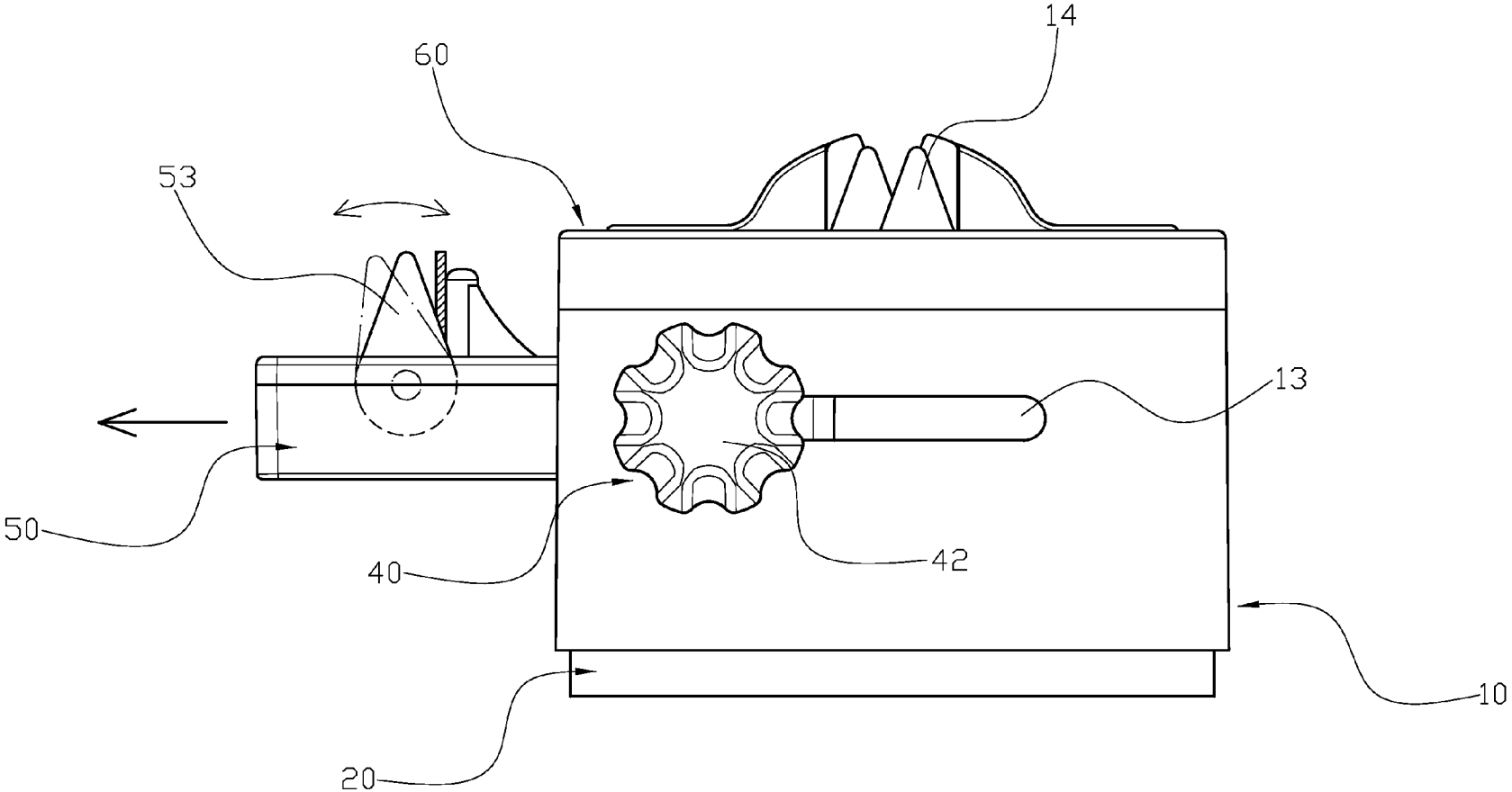
FIG. 8 is a schematic view of the second hone that swings during different honing positions in the present invention.
Figure 9:
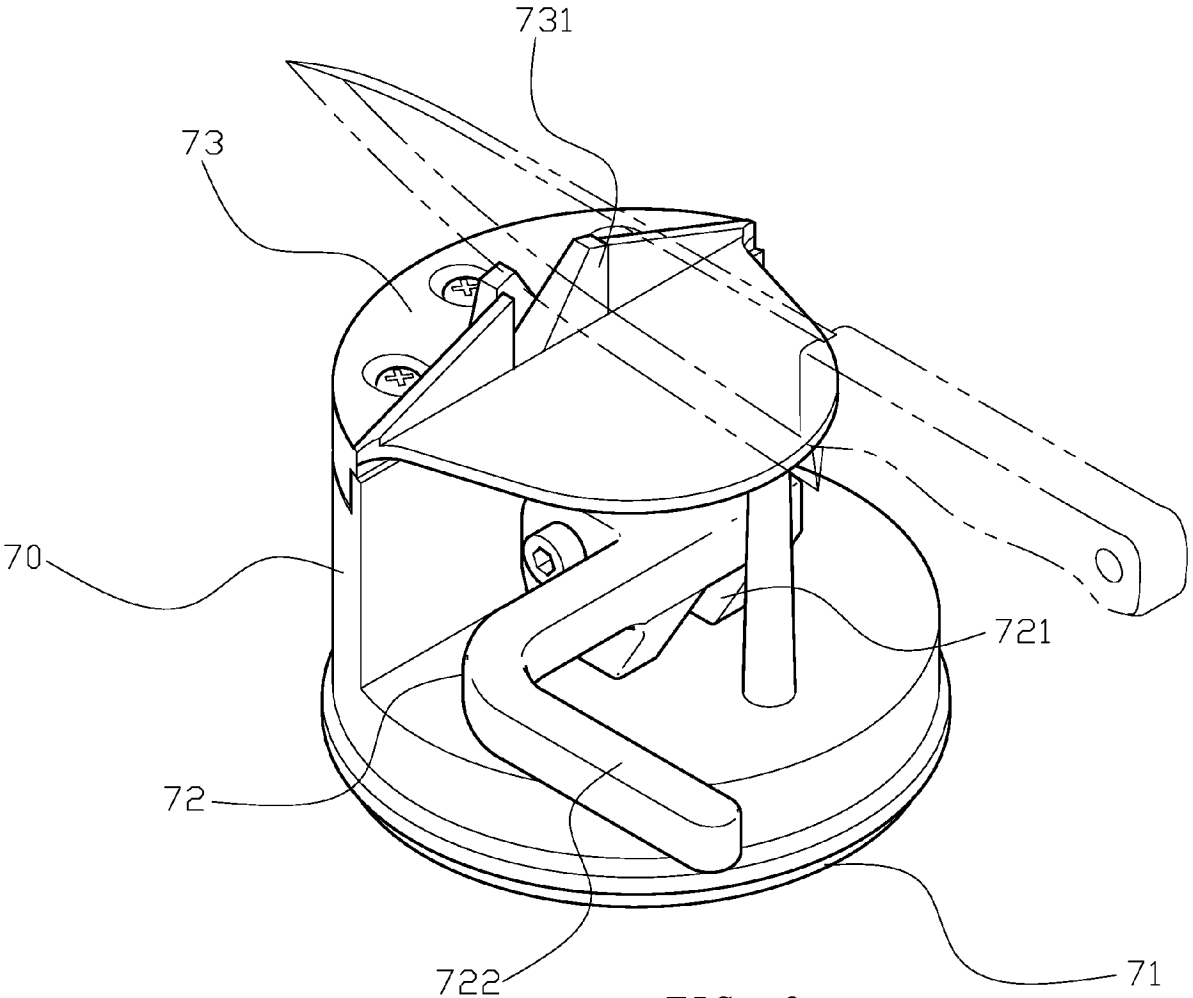
FIG. 9 PRIOR ART
FIG. 9 illustrates a three-dimensional view of a conventional honing apparatus and schematic view of the honing process.

When a user uses this apparatus, the suction plate (20) is placed on a smooth surface and the user controls the manipulating portion (32) so that the eccentric protruding portion (31) can be against the body (10) to pull the suction plate (20) out and the vacuum suction force can be generated accordingly. Furthermore, the body (10) can push down the circumference of the suction plate (20) to actually secure the suction plate on the surface. At this time, the user can hone dull kitchen knives, fruit knives, etc. back and forth on the first hone (14) until the knives become sharp again. When the user wants to hone scissors or garden scissors with dual blades, the user can loosen the rotating button (42) to push forward the driving unit (40), so that the threaded stick (41) connected with the connecting unit (50) can move forward on the sliding trough (13) and the trough (12), and further pushes the second hone (53) out of the body (10) so the second hone (53) is not covered by the base (11) and the upper cap (60) (See FIGS. 6 and 7). At this time, since the connecting unit (50) is not too thick and the dual blades can escape on both sides thereof, honing the dual-blade tools such as scissors can be achieved. When the honing process is complete, the user can push the driving unit (40) back and hide the second hone (53) again in the body (10). This design can prevent a protruding sharp object outside the base from hurting people and because the second hone (53) is hingedly engaged, it can swing while the blade(s) is moving (see FIG. 8) and the second hone (53) can keep in contact with the blades during the honing process to averagely and smoothly hone the knife.

According to the structure stated above, the structure in the present invention has the following advantages: (i) the honing base has both the first hone (14) and the second hone (53), and the second hone (53) can hone both single-blade and dual-blade knives with different movement design in the same structure. Also, when honing dual-blade knives, it is not necessary to separate the blades from the knife. So, the design can serve the purposes of convenience and good applicability; (ii) the extension of the second hone (53) can be adjusted according to the size of the dual-blade tools. So, the structure in the present invention is more flexible during the honing process; (iii) when the use finishes honing, the second hone (53) can be completely hidden in the body (10), so it not only saves space, but also prevent the user from hurting since the user may accidentally touch the second hone (53); (iv) the structure in the present invention is simple and easy to assemble, so that the costs of materials, assembly and molding can be reduced; (v) the honing base in the present invention is easy to operate since the user only has to know some simple operations such as rotating and horizontal moving; and (vi) the second hone (53) can swing according to different thickness of the blade, so that the second hone (53) can keep contacting the blade and averagely hone it.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A honing apparatus, comprising a body, a driving unit, a connecting unit and an upper cap, and the honing apparatus includes a corresponding suction unit, wherein a base is formed around circumference of the body, and a trough is formed in the middle of the base to penetrate both forward and upward, and the base has a sliding trough formed at one side wall of the body to connect the trough and outer space, and a first hone is at a top surface of the body, wherein the driving unit has a threaded stick and one end of the threaded stick has a rotating button, wherein the connecting unit is elongated and a through opening is located at a closer end of a lateral surface thereof, and a threaded unit is aligned with the through opening in the connecting unit, and a top surface of the connecting unit close to the other end has a second hone hingedly engaged with the connecting unit, such that the second hone swingingly moves along an edge of a knife and closely contacts the knife during entire honing process, wherein the upper cap matches the body to cover an upper portion of the base and a bottom surface corresponding to the sliding trough has a recessed portion, and a hole is formed to enable the first hone to penetrate upward, and wherein the connecting unit is inserted into the trough of the body when the second hone faces outside, and the threaded stick of the driving unit is inserted from the sliding trough and through the through opening of the connecting unit to screw onto the threaded unit, and when the driving unit is tightly screwed and forces an inner face of the rotating button on the base, the driving unit and the connecting unit are secured, and the upper cap matches and engages with the body when the recessed portion and the hole are escaping.

2. The honing apparatus of claim 1, wherein the suction unit comprises a suction plate and a control unit, wherein a through hole is formed at the body and a pulling stick is extended from a center of a lateral surface of the suction plate, so that the pulling stick is configured to penetrate the through hole to hingedly secure the control unit and components thereof that have an eccentric protruding unit, and the other lateral surface of the body has an extended manipulating portion.

3. The honing apparatus of claim 1, wherein the threaded unit is a screw nut.

4. The honing apparatus of claim 1, wherein an escaping bevel is tangentially formed at the connecting unit corresponding to the second hone.

* * * * *